US006450290B1

(12) United States Patent
Spak

(10) Patent No.: US 6,450,290 B1
(45) Date of Patent: Sep. 17, 2002

(54) FOLDING LADDER

(76) Inventor: George E. Spak, P.O. Box 7, Chenango Bridge, NY (US) 13745

( * ) Notice: Subject to any disclaimer, the term of this patent is extended or adjusted under 35 U.S.C. 154(b) by 0 days.

(21) Appl. No.: 09/587,012

(22) Filed: Jun. 5, 2000

(51) Int. Cl.[7] ..... E06C 1/00

(52) U.S. Cl. ..... 182/165; 182/156; D25/64; D25/65

(58) Field of Search ..... 182/161, 165, 182/156, 22–26; D25/64, 65

(56) References Cited

U.S. PATENT DOCUMENTS

| | | | | | |
|---|---|---|---|---|---|
| 1,153,558 | A | * | 9/1915 | Matheny | 182/165 X |
| 1,198,739 | A | * | 9/1916 | Marciniak et al. | 182/165 X |
| 2,010,588 | A | * | 8/1935 | Gooden | 182/106 |
| 147,350 | A | * | 8/1947 | Raffman, Jr. | D25/65 |
| 194,399 | A | * | 1/1963 | De Muth et al. | D25/65 X |
| 4,125,175 | A | * | 11/1978 | Ernst | 182/194 |
| 4,723,631 | A | * | 2/1988 | Tremblay | 182/161 |
| 343,906 | A | * | 2/1994 | Murray | D25/64 |
| 5,722,507 | A | * | 3/1998 | Kain | 182/165 X |
| 5,762,163 | A | * | 6/1998 | Kain | 182/161 |
| 5,967,260 | A | | 10/1999 | Spak | 182/165 |
| 6,012,548 | A | * | 1/2000 | Kim | 182/165 |

FOREIGN PATENT DOCUMENTS

| | | | | |
|---|---|---|---|---|
| IT | 65492 | * | 4/1982 | 182/165 |

* cited by examiner

*Primary Examiner*—Daniel P. Stodola
*Assistant Examiner*—Hugh B. Thompson
(74) *Attorney, Agent, or Firm*—Salzman & Levy

(57) ABSTRACT

A lightweight, folding ladder having steps that fold together and lie flat within the frame, when the legs of the frame are collapsed into a fold-away position. The steps each have an edge recess that allows a person climbing the ladder to laterally draw closer to an object or supporting wall when the ladder is in a legs-expanded, open-frame, operative position.

10 Claims, 2 Drawing Sheets

FOLDING LADDER

FIELD OF THE INVENTION

The present invention relates to climbing devices and, more particularly, to a lightweight, folding ladder that provides steps adapted to fold together and lie flat within the frame when the legs of the frame are collapsed into a fold-away position, and whose steps each have a recess that allows a person climbing the ladder to laterally draw closer to an object or supporting wall, when the ladder is in a legs-expanded, open-frame, operative position.

BACKGROUND OF THE INVENTION

In the art of folding ladders with folding steps, it is often observed that the steps of the ladder do not completely fold flat within the frame, when the ladder is folded into an inoperative position. This results in a ladder that is unnecessarily more bulky, when folded.

Another problem that is often encountered with folding ladders is their inability to provide close lateral access to a supporting wall or an object that the user is trying to reach. Although the climber is able to gain height when ascending the steps of the ladder, he is often thwarted from easily approaching an object in the lateral direction. This is so because the edge of each step of the ladder projects beyond the legs of the frame, and abuts the knees and shins of the user as he climbs. The abutting nature of the steps prevents the climber from reaching inwardly towards either a supporting wall or an object that he is trying to reach. In other words, the user cannot step inwardly toward the supporting wall, because his legs are blocked by the steps.

Another problem associated with folding ladders is the thickness of the frame construction. The legs are fabricated unnecessarily thick in order to provide a means by which the internal steps will have sufficient width for the sole of the foot of a climber. Although the user appreciates a well constructed ladder having thick legs and sufficient step width, the added bulk makes the ladder heavier and less maneuverable.

It has been found useful to provide ladders with steps having a large surface area, so that more stability can be provided for the user. This is particularly true when individuals age, and they become less steady as they climb. A folding ladder comprising folding steps having a large surface area is illustrated in U.S. Pat. No. 5,967,260, issued to the present inventor, George E. Spak, on Oct. 19, 1999. The ladder of this invention has large sized steps that can be pushed inwardly beyond the side rails of the frame, so that the climbing individual can lean closer to an object or the supporting wall.

The present invention seeks to include all of the advantages of the aforementioned ladder, yet provide some improvements thereto.

The current invention provides a lightweight folding ladder, whose aluminum, tubular side rails are extremely thin to reduce both weight and bulk. The thin, tubular side rails also allow the climber of the ladder to grip the side rails easily within clenched fists. This provides more stability to the climber as he ascends and descends the ladder. The ladder includes a first, tubular side rail member that is "U"-shaped at the top. Below the top, in a mid-portion of the rails of the first side rail member, a second tubular side rail member is pivotally attached to the first side rails, thus allowing the first and second tubular side rail members to fold upon each other. The ladder also comprises a series of large sized steps that are each pivotally secured to an elongated bar. The steps are upwardly and downwardly foldable within the side rail members in unison, by reason of the elongated bar. Each of the steps also comprises a front edge recess that allows a climber to lean inwardly past the first side rails. The recesses provide a means by which the climber can move laterally closer to a supporting wall or an object. A pair of folding side bars is pivotally attached between the side rails of the first and second side rail members, in order to provide greater stability to the expanded frame. A series of rear support bars extends between the side rails of the second side rail member. The top rear support bar provides a stop for the forward edge of the top step, when the steps are in a fold-down, operative position.

SUMMARY OF THE INVENTION

In accordance with the present invention, there is provided a lightweight folding ladder, whose aluminum, tubular side rails are extremely thin to reduce both weight and bulk. The thin, tubular side rails also allow the climber of the ladder to grip the side rails easily within clenched fists. This provides more stability to the climber as he ascends and descends the ladder.

The ladder includes a first, tubular side rail member that is "U"-shaped at the top. Below the top, in a mid-portion portion of the rails of the first side rail member, a second tubular side rail member is pivotally attached to the first side rails, thus allowing the first and second tubular side rail members to fold upon each other. The ladder also comprises a series of large sized steps that are each pivotally secured to an elongated bar. The steps are upwardly and downwardly foldable within the side rail members in unison, by reason of the elongated bar. Each of the steps also comprises a front edge recess that allows a climber to lean inwardly past the first side rails. The recesses provide a means by which the climber can move laterally closer to a supporting wall or an object. A pair of folding side bars is pivotally attached between the side rails of the first and second side rail members, in order to provide greater stability to the expanded frame, in an operative position. A series of rear support bars extends between the side rails of the second side rail member. The top rear support bar provides a stop for the forward edge of the top step, when the steps are in a fold-down, operative position.

It is an object of this invention to provide an improved folding ladder having large sized folding steps.

It is another object of the invention to provide a folding ladder having large sized folding steps and that is both lightweight and compact.

It is still another object of this invention to provide a folding ladder having large sized folding steps that fold in unison both downwardly and upwardly to their respective operative and inoperative positions.

BRIEF DESCRIPTION OF THE DRAWINGS

A complete understanding of the present invention may be obtained by reference to the accompanying drawings, when considered in conjunction with the subsequent detailed description in which.

For purposes of clarity and brevity, like elements and components shall bear the same numerical designations throughout the figures.

DESCRIPTION OF THE PREFERRED EMBODIMENT

Generally speaking, the invention features a lightweight, folding ladder. The ladder has steps that fold together and lie flat within the frame when the legs of the frame are collapsed into a fold-away position. The steps each comprise a recess that allows a person climbing the ladder to laterally draw closer to an object or supporting wall, when the ladder is in a legs-expanded, open-frame, operative position.

Figure 1:
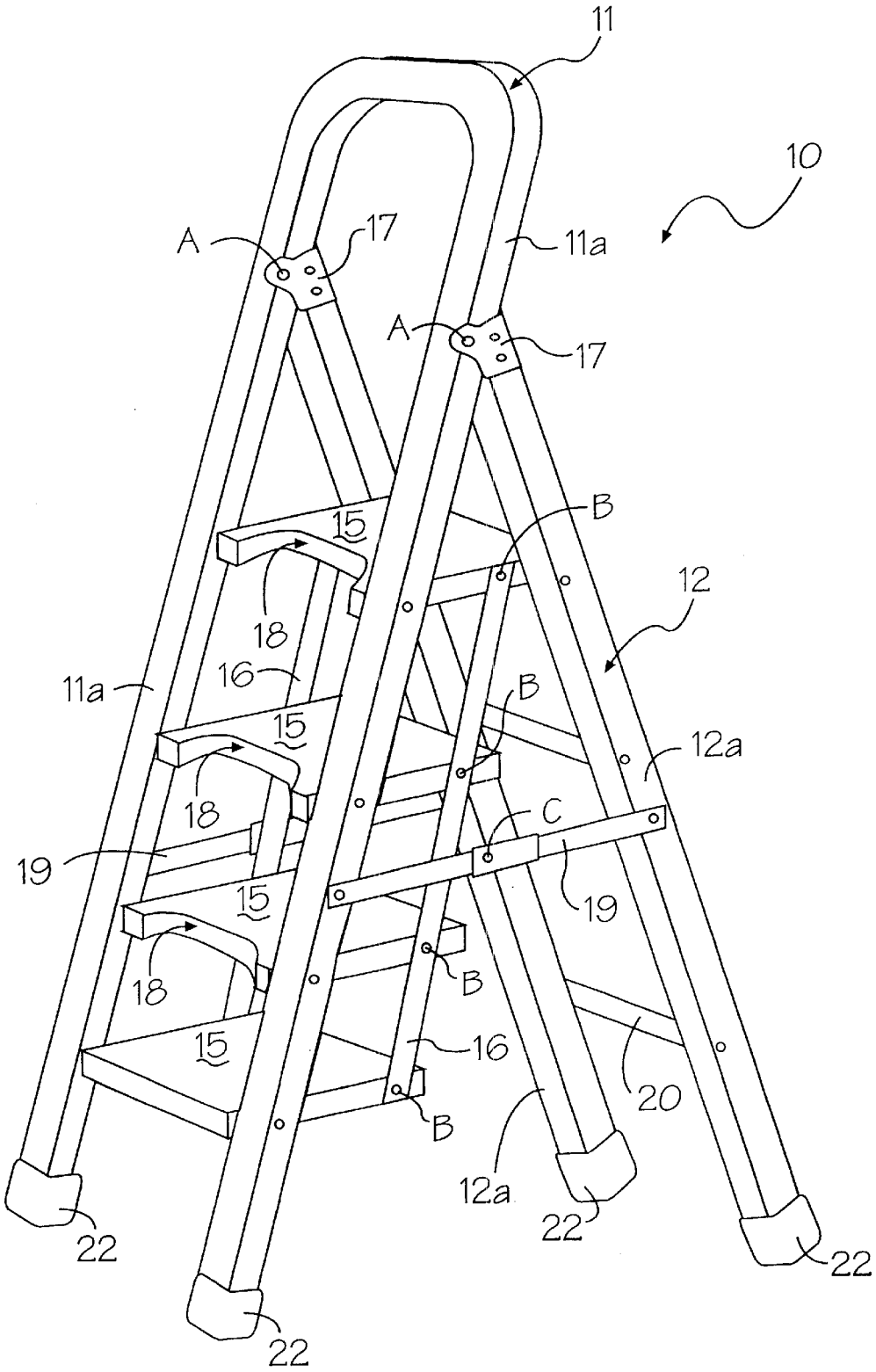
FIG. 1 illustrates a perspective view of the ladder of this invention, shown in a legs-expanded, open-frame, operative position.

Now referring to FIG. 1, a folding ladder 10 of this invention is illustrated in its operative position. The folding ladder 10 comprises a first frame member 11 shaped like an elongated "U". The frame member 11 comprises a pair of aluminum, tubular, side rails 11*a,* that are extremely thin to reduce both weight and bulk. The thin, tubular side rails 11*a* also provide the climbing user (not shown) of ladder 10 to grip them easily with clenched fists. This provides more stability to the climber, as he ascends and descends the ladder.

Figure 2:
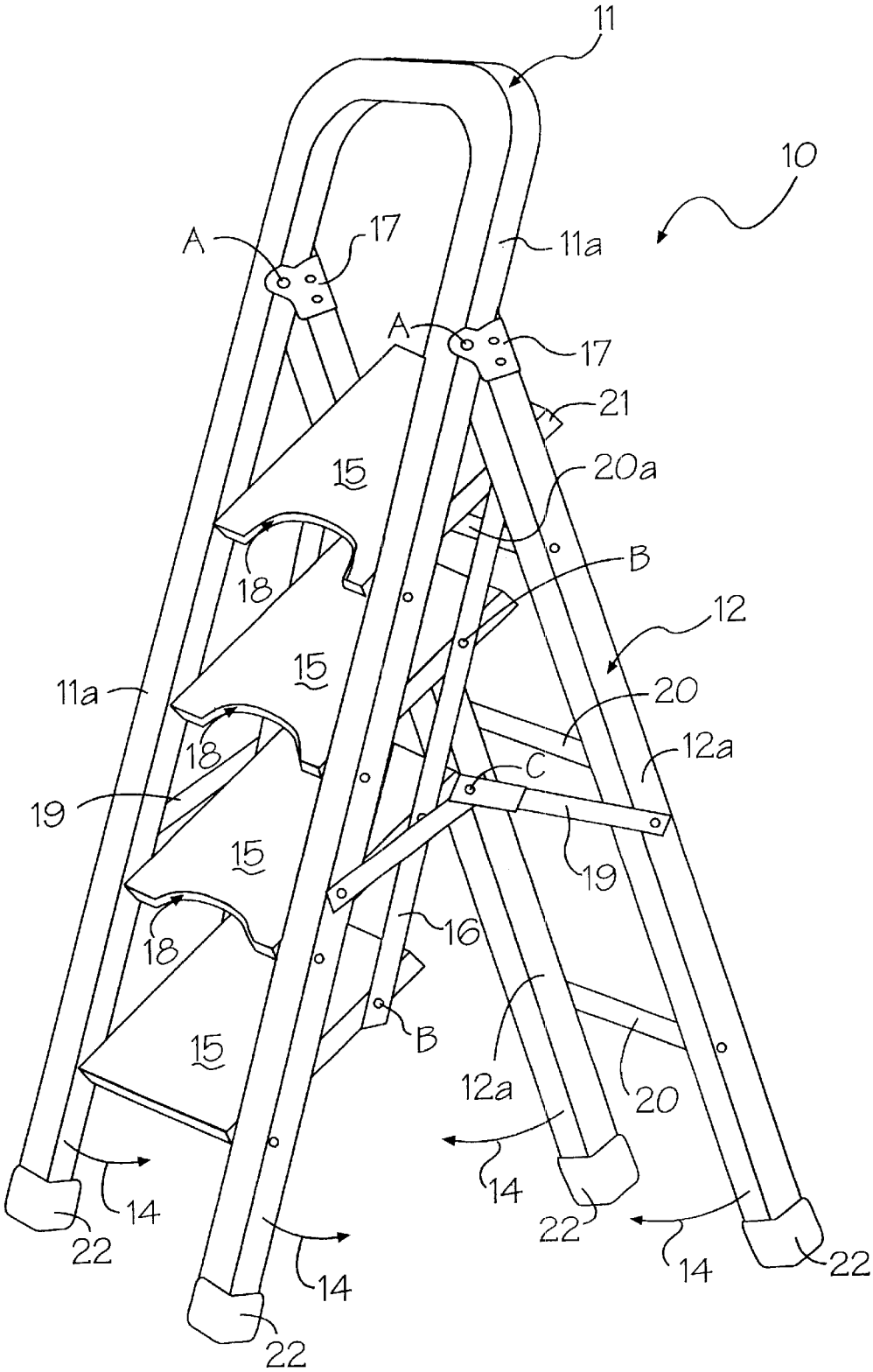
FIG. 2 shows a perspective view of the ladder depicted in FIG. 1, as it is being folded into its inoperative, fold-away position.

The ladder 10 also includes a second frame member 12 that is pivotally attached below the top of the first frame member 11 at pivot points "A". The second frame member 12 comprises tubular, side rails 12*a.* The tubular side rails 11*a* and 12*a,* respectively, can comprise a circular or square cross-section. The first and second frame members 11 and 12 are pivotally secured to each other through brackets 17, and pivot with respect to each other about points "A", thus allowing the first and second tubular side rail members 11*a* and 12*a* to fold upon each other (arrows 14), as illustrated in FIG. 2.

The ladder 10 also comprises a series of large sized steps 15 that are each pivotally secured to left and right, elongated, translation bars 16, about respective pivot points "B". The steps 15 are upwardly and downwardly foldable in unison within the side rail members 11*a* and 12*a,* respectively, by reason of the elongated, translation bars 16. Each of the steps 15 (with the exception of the lowermost, first step) also comprises a front edge recess 18 that allows a climber to lean inwardly past the first side rails 11*a.* The recesses 18 provide a means by which the climber can move laterally closer to a supporting wall or an object. Recesses 18 are formed progressively deeper in the respective steps 15 as the steps are disposed above one another; that is, the higher the step 15, the deeper its recess 18.

A pair of folding side bars 19 is pivotally attached between the pair of side rails 11*a* and 12*a,* respectively, of the first and second side rail members 11 and 12, in order to provide greater stability and bracing to the expanded frame, in the operative position, as shown in FIG. 1. The side bars 19 pivot about pivot point "C", as illustrated in FIG. 2. A series of rear support bars 20 extends between the side rails 12*a* of the second frame member 12. The top rear support bar 20*a* (FIG. 2) provides a stop for the forward edge 21 of the top step 15, when the steps 15 are in a fold-down, operative position, as illustrated in FIG. 1. All of the steps 15 are stopped when the leading edge 21 of top step 15 contacts the support bar 20*a,* because they operate in unison by reason of the left and right, elongated, translation bars 16.

Rubber grommets 22 are provided upon the distal ends of the respective rails 11*a* and 12*a* in order to prevent skidding on slick floors.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A lightweight folding ladder, comprising:

a first frame member having a pair of side rails;

a second frame member having a pair of side rails that are pivotally attached to respective side rails of said first frame member, thus allowing said first and second frame members to fold with respect to each other from a fold-down, inoperative position, to a rails-expanded, open-frame, operative position;

a plurality of steps pivotally disposed between the pair of side rails of said first frame member, all of said plurality of steps having a recess disposed at a mid-portion of a forward edge thereof, with the exception of a first step for allowing a climber of said ladder to lean inwardly between the side rails of said first frame member;

an elongated, translation bar pivotally attached to each of said plurality of steps, so that each of said plurality of steps will fold in a nesting fashion upon an adjacent step, creating a substantial overlap of the steps, said elongated, translation bar causing each of said plurality of steps to fold in unison with respect to the pair of side rails of said first frame member; and a pair of pivotally disposed side bars disposed between respective side rails of said first and second frame members for providing bracing and stability to said ladder in said rails-expanded, open-frame, operative position.

2. The lightweight folding ladder in accordance with claim 1, wherein said side rails of said first and second frame members, respectively, are tubular.

3. The lightweight folding ladder in accordance with claim 1, further comprising rear bar supports disposed between side rails of said second frame support for providing support and bracing to said ladder.

4. The lightweight folding ladder in accordance with claim 3, wherein a top rear bar support provides a fold-down stop for a top step of said plurality of steps.

5. The lightweight folding ladder in accordance with claim 1, wherein said side rails of said first and second frame members, respectively, comprise aluminum.

6. A lightweight folding ladder having fold down steps, comprising:

a first tubular frame member having a pair of side rails;

a second tubular frame member having a pair of side rails that is pivotally attached to respective side rails of said first frame member, thus allowing said first and second frame members to fold with respect to each other from a fold-down, inoperative position, to a rails-expanded, open-frame, operative position;

a plurality of steps pivotally disposed between the pair of side rails of said first frame member all of said plurality of steps having a recess disposed at a mid-portion of a forward edge thereof, with the exception of a first step for allowing a climber of said ladder to lean inwardly between the side rails of said first frame member;

an elongated, translation bar pivotally attached to each of said plurality of steps so that each of said plurality of steps. will fold in a nesting. fashion upon an adjacent step, creating a substantial overlap of the steps, said elongated, translation bar causing each of said plurality of steps to fold in unison with respect to the pair of side rails of said first frame member; and a pair of pivotally disposed side bars disposed between respective side rails of said first and second frame members for providing bracing and stability to said ladder in said rails-expanded, open-frame, operative position.

7. The light-weight folding ladder in accordance with claim 6, wherein each of said edge recesses is formed progressively deeper than the edge recess of the step below it, so that said climber can move progressively closer to a supporting wall or object as said climber moves up the ladder.

8. The lightweight folding ladder in accordance with claim 6, further comprising rear bar supports disposed between side rails of said second frame support for providing support and bracing to said ladder.

9. The lightweight folding ladder in accordance with claim 8, wherein a top rear bar support provides a fold-down stop for a top step of said plurality of steps.

10. The lightweight folding ladder in accordance with claim 6, wherein said side rails of said first and second frame members, respectively, comprise aluminum.

* * * * *